US011386844B2

(12) United States Patent
Jeon et al.

(10) Patent No.: US 11,386,844 B2
(45) Date of Patent: Jul. 12, 2022

(54) DISPLAY DEVICE AND METHOD FOR DRIVING THE SAME

(71) Applicant: SAMSUNG DISPLAY CO., LTD., Yongin-si (KR)

(72) Inventors: Jae Hyeon Jeon, Yongin-si (KR); Joon Chul Goh, Yongin-si (KR); Jin Wook Yang, Yongin-si (KR); Ki Hong Song, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/943,197

(22) Filed: Jul. 30, 2020

(65) Prior Publication Data

US 2021/0049965 A1 Feb. 18, 2021

(30) Foreign Application Priority Data

Aug. 12, 2019 (KR) ..... 10-2019-0098324

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0819* (2013.01); *G09G 2310/08* (2013.01); *G09G 2320/0233* (2013.01); *G09G 2330/028* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,913,090 | B2 | 12/2014 | Chung et al. | |
| 8,957,837 | B2 * | 2/2015 | Han | G09G 3/3233 345/78 |
| 9,552,791 | B2 * | 1/2017 | Bae | G09G 5/001 |
| 9,715,293 | B2 * | 7/2017 | Chung | G06F 3/0445 |
| 2011/0164071 | A1 * | 7/2011 | Chung | G09G 3/3233 345/690 |
| 2012/0013597 | A1 * | 1/2012 | Han | G09G 3/3233 345/212 |
| 2015/0358018 | A1 * | 12/2015 | Kim | H03K 17/223 345/208 |
| 2017/0337889 | A1 * | 11/2017 | Wei | G09G 3/3677 |
| 2018/0322831 | A1 * | 11/2018 | Kim | G09G 3/3266 |
| 2020/0394962 | A1 * | 12/2020 | Seo | G09G 3/3275 |
| 2021/0027697 | A1 * | 1/2021 | Yoon | G09G 3/32 |
| 2021/0280136 | A1 * | 9/2021 | Shin | G09G 3/3291 |

FOREIGN PATENT DOCUMENTS

| | | | |
|---|---|---|---|
| KR | 100993117 | B1 | 11/2010 |
| KR | 101127582 | B1 | 3/2012 |
| KR | 101162864 | B1 | 7/2012 |

* cited by examiner

*Primary Examiner* — Van N Chow
(74) *Attorney, Agent, or Firm* — Cantor Colburn LLP

(57) ABSTRACT

A display device includes: a plurality of pixels, where each of the pixels includes a light emitting device and a pixel circuit coupled to the light emitting device; a scan driver which supplies a scan signal to the pixel circuit; a data driver which supplies a data signal to the pixel circuit; a power supply which supplies a voltage to the pixel circuit; a timing controller which controls the scan driver; a first signal generator which provides a first clock signal to the timing controller; and a second signal generator which provides a second clock signal to the timing controller.

18 Claims, 9 Drawing Sheets

<@120Hz>

<@60Hz>

DISPLAY DEVICE AND METHOD FOR DRIVING THE SAME

This application claims priority to Korean patent application No. 10-2019-0098324, filed on Aug. 12, 2019, and all the benefits accruing therefrom under 35 U.S.C. § 119, the content of which in its entirety is herein incorporated by reference.

BACKGROUND

1. Field

The invention relates to a display device and a method for driving the display device, and more particularly, to a display device for variable frequency driving and a variable frequency driving method.

2. Related Art

Recently, as society advances to the information-oriented society, the field of display devices for visually expressing an electrical information signal has rapidly advanced. Various display devices, having desired characteristics such as thin profile, light weight, and low power consumption, have been developed.

Such display devices include liquid crystal display devices, field emission display devices, organic light emitting display devices, etc.

In an organic light emitting display device, each of a plurality of pixels thereof includes an organic light emitting diode configured with an organic emitting layer between an anode electrode and a cathode electrode, and a pixel circuit that independently drives the organic light emitting diode. The pixel circuit includes a switching thin film transistor, a driving thin film transistor, and a capacitor.

SUMMARY

In an organic light emitting display device, the pixels are different from each other in a threshold voltage and mobility of the driving thin film transistor due to a process variation or the like. Also, a voltage drop of a high-potential voltage occurs, so that the amount of current for driving the organic light emitting diode may be changed. Therefore, a luminance difference between the pixels may occur. In general, an unintended mura or pattern may appear on a screen due to a difference in initial characteristic of the driving thin film transistor. Also, a characteristic difference caused by deterioration of the driving thin film transistor that may occur while the organic light emitting diode is being driven may reduce the lifetime of the organic light emitting diode or cause image sticking. Thus, a compensation circuit capable of compensating a characteristic difference of a driving thin film transistor and a voltage drop of a high-potential voltage may be included in the pixels to reduce a luminance difference between pixels.

In addition, various methods of driving the organic light emitting display device have been researched to reduce power consumption of an organic light emitting display device. As one of the driving methods capable of reducing power consumption, a driving method for selectively decreasing a frequency for driving the organic light emitting display device to a fundamental driving frequency has been researched.

Embodiments of the disclosure relate to a display device capable of securing a compensation time in high-frequency driving, which corresponds to a compensation time in low-frequency driving.

In accordance with an embodiment of the disclosure, a display device includes: a plurality of pixels, where each of the pixels includes a light emitting device and a pixel circuit coupled to the light emitting device; a scan driver which supplies a scan signal to the pixel circuit; a data driver which supplies a data signal to the pixel circuit; a power supply which supplies a voltage to the pixel circuit; a timing controller which controls the scan driver; a first signal generator which provides a first clock signal to the timing controller; and a second signal generator which provides a second clock signal to the timing controller.

In an embodiment, the timing controller may control the scan driver based on the first clock signal to supply a first scan signal to the pixel circuit, and control the scan driver based on the second clock signal to supply a second scan signal to the pixel circuit.

In an embodiment, the data signal may be supplied to the pixel circuit from the data driver, while the first scan signal is being supplied to the pixel circuit, and the voltage may be supplied to the pixel circuit from the power supply, while the second scan signal is being supplied to the pixel circuit.

In an embodiment, the first scan signal and the second scan signal may be supplied to the pixel circuit, while the light emitting device is not emitting light.

In an embodiment, the first scan signal may be supplied to the pixel circuit after the second scan signal is supplied to the pixel circuit.

In an embodiment, the voltage may be an initialization voltage for initializing a gate electrode of a driving transistor in the pixel circuit.

In an embodiment, the display device may further include: a data line to which the data signal is supplied; a first scan line to which a first scan signal is supplied from the scan driver; a second scan line to which a second scan signal is supplied from the scan driver; and a first power voltage supply line to which a first power voltage is supplied from the power supply. In such an embodiment, the pixel circuit may include: a first transistor including a first electrode coupled to the first power voltage supply line, a second electrode, and a first gate electrode coupled to a first node; a second transistor including a third electrode coupled to the data line, a fourth electrode coupled to a second node, and a second gate electrode coupled to the first scan line; and a third transistor including a fifth electrode coupled to the first node, a sixth electrode coupled to the second electrode, and a third gate electrode coupled to the second scan line.

In an embodiment, the pixel circuit may further include: a first capacitor coupled between the first power voltage supply line and the second node; and a second capacitor coupled between the first node and the second node.

In an embodiment, the display device may further include: a third scan line to which a third scan signal is supplied from the scan driver; and an initialization voltage supply line to which an initialization voltage is supplied from the power supply. In such an embodiment, the pixel circuit may further include a fourth transistor including a seventh electrode coupled to the first node, an eighth electrode coupled to the initialization voltage supply line, and a fourth gate electrode coupled to the third scan line.

In an embodiment, during a period in which the light emitting device does not emit light, the second scan signal may be supplied to the pixel circuit after the third scan signal is supplied to the pixel circuit, and the first scan signal may be supplied to the pixel circuit after the second scan signal is supplied to the pixel circuit.

In an embodiment, each of the first transistor, the second transistor, the third transistor and the fourth transistor may be a P-type transistor.

In an embodiment, the first scan signal may be supplied from the scan driver when the first clock signal is provided thereto, and the second scan signal may be supplied from the scan driver when the second clock signal is supplied thereto.

In an embodiment, the display device may be driven with a variable frequency driving using a first frequency and a second frequency, which are different from each other.

In an embodiment, a length of a time for which the second scan signal is supplied to the pixel circuit when the display device is driven at the first frequency may be equal to a length of a time for which the second scan signal is supplied to the pixel circuit when the display device is driven at the second frequency.

In an embodiment, the first frequency may be in a range of about 1 hertz (Hz) to about 60 Hz, and the second frequency may be in a range of about 120 Hz to about 250 Hz.

In an embodiment, the display device may be driven with the variable frequency driving further using a third frequency different from the first frequency and the second frequency. In such an embodiment, the third frequency may be in a range of about 60 Hz to about 120 Hz.

In an embodiment, the first signal generator and the second signal generator may be disposed at an outside of the timing controller and the scan driver.

In an embodiment, the first signal generator and the second signal generator may be provided independently of each other.

In accordance with another embodiment of the disclosure, a method for driving a display device which is driven with a variable frequency driving using a first frequency and a second frequency, which are different from each other, the method including: providing, by a first signal generator of the display device, a first clock signal to a timing controller of the display device, and supplying, by a scan driver of the display device based on the first clock signal, a first scan signal to a pixel circuit of the display device, where the scan driver is controlled by the timing controller; and providing, by a second signal generator of the display device, a second clock signal to the timing controller, and supplying, by the scan driver, a second scan signal to the pixel circuit based on the second clock signal.

In an embodiment, the method may further include: providing, by the first signal generator, the first clock signal to the timing controller, and supplying, by the scan driver, a third scan signal to the pixel circuit based on the first clock signal; and providing, by the second signal generator, the second clock signal to the timing controller, and supplying, by the scan driver, supplying a fourth scan signal to the pixel circuit based on the second clock signal. In such an embodiment, the first scan signal and the second scan signal may be supplied to the pixel circuit when the display device is driven at the first frequency, and the third scan signal and the fourth scan signal may be supplied to the pixel circuit when the display device is driven at the second frequency. In such an embodiment, a length of a time for which the first scan signal is supplied to the pixel circuit may be different from a length of a time for which the third scan signal is supplied to the pixel circuit, and a length of the time for which the second scan signal is supplied to the pixel circuit may be equal to a length of a time for which the fourth scan signal is supplied to the pixel circuit.

BRIEF DESCRIPTION OF THE DRAWINGS

The above and other features of the invention will become more apparent by describing embodiments thereof in detail with reference to the accompanying drawings, in which.

DETAILED DESCRIPTION

Figure 1:
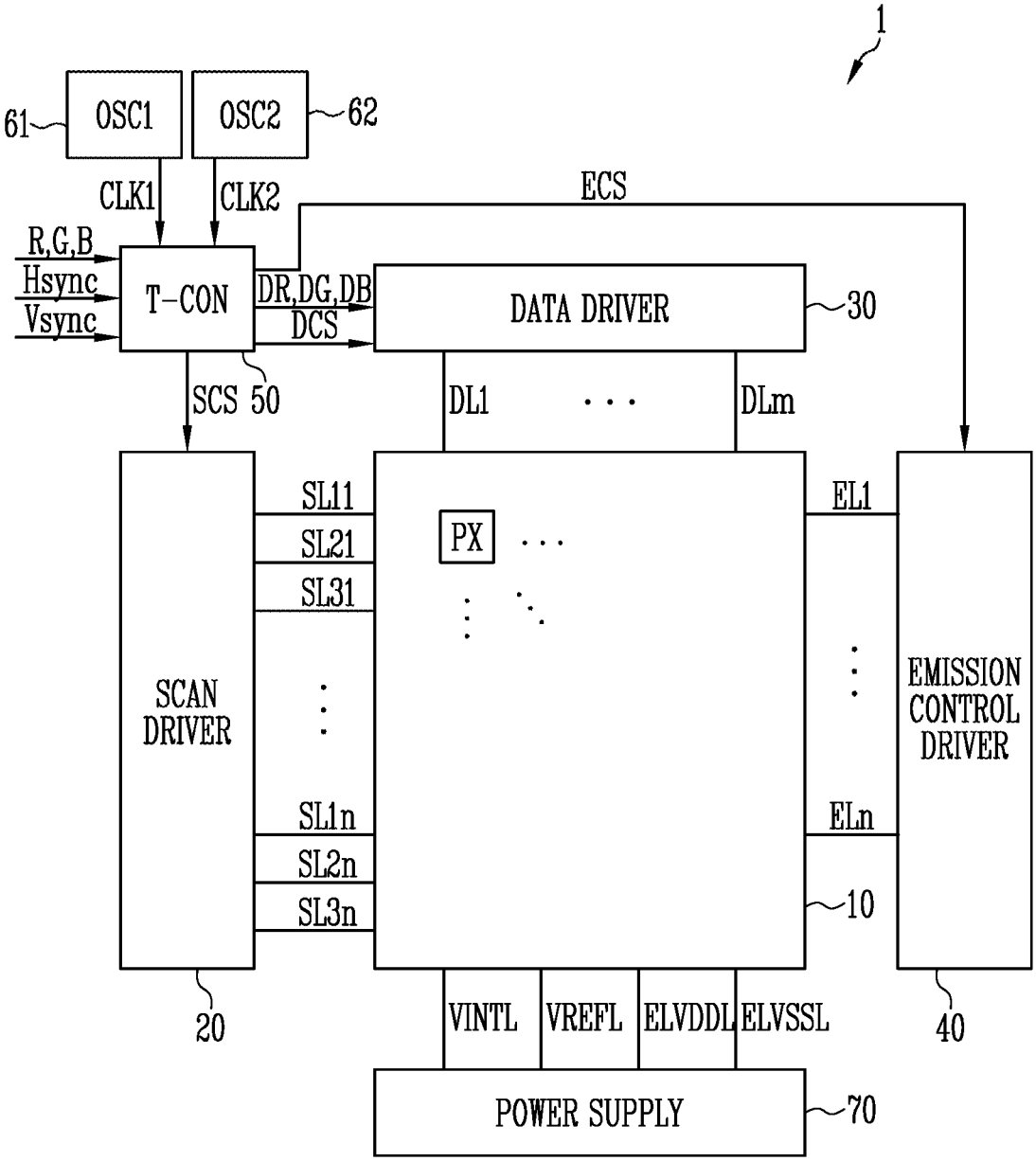
FIG. 1 is a schematic block diagram of an organic light emitting display device in accordance with an embodiment of the disclosure.

The invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. The same reference numbers indicate the same components throughout the specification. In the attached figures, the thickness of layers and regions is exaggerated for clarity.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "or" means "and/or." "At least one of A and B" means "A and/or B." As used to herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Display devices in accordance with various embodiments described herein are devices for displaying moving images or still images or devices for display stereoscopic images, and may be used as display screens of various products such as televisions, laptop computers, monitors, advertising boards, and Internet of things as well as portable electronic devices such as mobile communication terminals, smartphones, tablet computers, smart watches, and navigation systems.

Hereinafter, exemplary embodiments will be described with reference to the accompanying drawings. For convenience of description, embodiments where the display device is an organic light emitting display device will be described in detail. However, the disclosure is not limited thereto, and may be applied to another type of display device such as a liquid crystal display device, a field emission display device, or an electrophoretic display device.

FIG. 1 is a schematic block diagram of an organic light emitting display device in accordance with an embodiment of the disclosure.

Referring to FIG. 1, in an embodiment, the organic light emitting display device 1 includes a display 10 including a plurality of pixels PX, a scan driver 20, a data driver 30, and an emission control driver 40, a timing controller 50, a power supply 70, and a plurality of signal generators 61 and 62.

The display 10 includes a plurality of pixels PX connected to a plurality of scan lines SL11 to SL1*n*, SL21 to SL2*n*, and SL31 to SL3*n* (n is an integer greater than 1), a plurality of data lines DL1 to DLm (m is an integer greater than 1), and a plurality of emission control lines EL1 to ELn, and arranged substantially in a matrix form. In one embodiment, for example, the plurality of pixels PX may be located at intersection portions of the plurality of scan lines SL11 to SL1*n*, SL21 to SL2*n*, and SL31 to SL3*n*, the plurality of data lines DL1 to DLm, and the plurality of emission control lines EL1 to ELn. Each pixel PX includes a pixel circuit and a light emitting device coupled to (e.g., connected to) the pixel circuit. In an embodiment, the light emitting device may be an organic light emitting diode (see 'OLED' shown in FIG. 2).

The plurality of pixels may define light emitting areas that emit a plurality of colors. In one embodiment, for example, the plurality of pixels PX may define light emitting areas that emit red, green, and blue lights.

The plurality of scan lines SL11 to SL1*n*, SL21 to SL2*n*, and SL31 to SL3*n* and the plurality of emission control lines EL1 to ELn may extend in a row direction (lateral direction on the drawing), and the plurality of data lines DL1 to DLm may extend in a column direction (longitudinal direction on the drawing). The row direction and the column direction may be reserved. Although not clearly shown, an initialization voltage supply line VINTL and a reference voltage supply line VERFL may branch off for each row to extend in the row direction, and the first power voltage supply line ELVDDL may branch off for each column to extend in the column direction. However, the disclosure is not limited thereto, and the extending directions of the initialization voltage supply line VINTL and the first power voltage supply line ELVDDL may be variously modified.

Three scan lines SL11, SL21, and SL31, one data line DL1, one emission control line EL1, one initialization voltage supply line VINTL, one reference voltage supply line VREFL, and one first power voltage supply line ELVDDL may pass through or connected to a pixel PX of a corresponding row and a corresponding column. Such lines may pass through or connected to another pixel PX.

In an embodiment, the scan driver 20 generates and transfers three scan signals to each pixel PX through corresponding scan lines among the plurality of scan lines SL11 to SL1*n*, SL21 to SL2*n*, and SL31 to SL3*n*. In such an embodiment, the scan driver 20 sequentially supplies scan signals (see GD[j], GW[j] and GI[j] shown in FIG. 2 or GD, GI/GW in FIG. 5) to a corresponding first scan line among first scan lines SL11 to SL1*n*, a corresponding second scan line among second scan lines SL21 to SL2*n*, and a corresponding third scan line among third scan lines SL31 to SL3*n*, respectively.

The data driver 30 transfers a data signal to each pixel PX through a corresponding data line among the plurality of data lines DL1 to DLm. The data signal is supplied (or output) to a pixel PX selected by a first scan signal (see 'GD[j]' shown in FIG. 2) when the first scan signal is supplied to the corresponding first scan line among the first scan lines SL11 to SL1*n*.

The emission control driver 40 generates and transfer an emission control signal (see 'EM[j]' shown in FIG. 2) to each pixel PX through a corresponding emission control line among the plurality of emission control lines EL1 to ELn. The emission control signal controls an emission time of the pixel PX. Alternatively, the scan driver 20 generates not only the scan signal but also the emission control signal, and the emission control driver 40 may be omitted. Alternatively, an internal structure of the pixel PX may be variously modified to allow the emission control driver 40 to be omitted. In an embodiment, the emission control driver 40 may be included in the scan driver 20.

In an embodiment, the timing controller 50 converts a plurality of image signals R, G, and B transferred from the outside into a plurality of image data signals DR, DG, and DB, and transfers the plurality of image data signals DR, DG, and DB to the data driver 30. In such an embodiment, the timing controller 50 receives a vertical synchronization signal Vsync, a horizontal synchronization signal Hsync, and clock signals CLK1 and CLK2 to generate and transfer control signals for controlling driving of the scan driver 20, the data driver 30, and the emission control driver 40, e.g., a scan driving control signal SCS for controlling the scan driver 20, a data driving control signal DCS for controlling the data driver 30, and an emission driving control signal ECS for controlling the emission control driver 40.

A first signal generator 61 and a second signal generator 62 respectively transfer a first clock signal CLK1 and a second clock signal CLK2 to the timing controller 50. The first clock signal CLK1 and the second clock signal CLK2 may be provided to the timing controller 50 independently of each other. Accordingly, the timing controller 50 may generate a plurality of timing signals based on the first clock signal CLK1 and the second clock signal CLK2. In an embodiment, each of the first signal generator 61 and the second signal generator 62 may be an oscillator, e.g., a first oscillator OSC1 and a second oscillator OSC2. In an embodiment, the first signal generator 61 and the second signal generator 62 may be separate components disposed outside of the timing controller 50 or the scan driver 20. In an embodiment, the first signal generator 61 and the second signal generator 62 may be separate components independent from each other.

Figure 2:
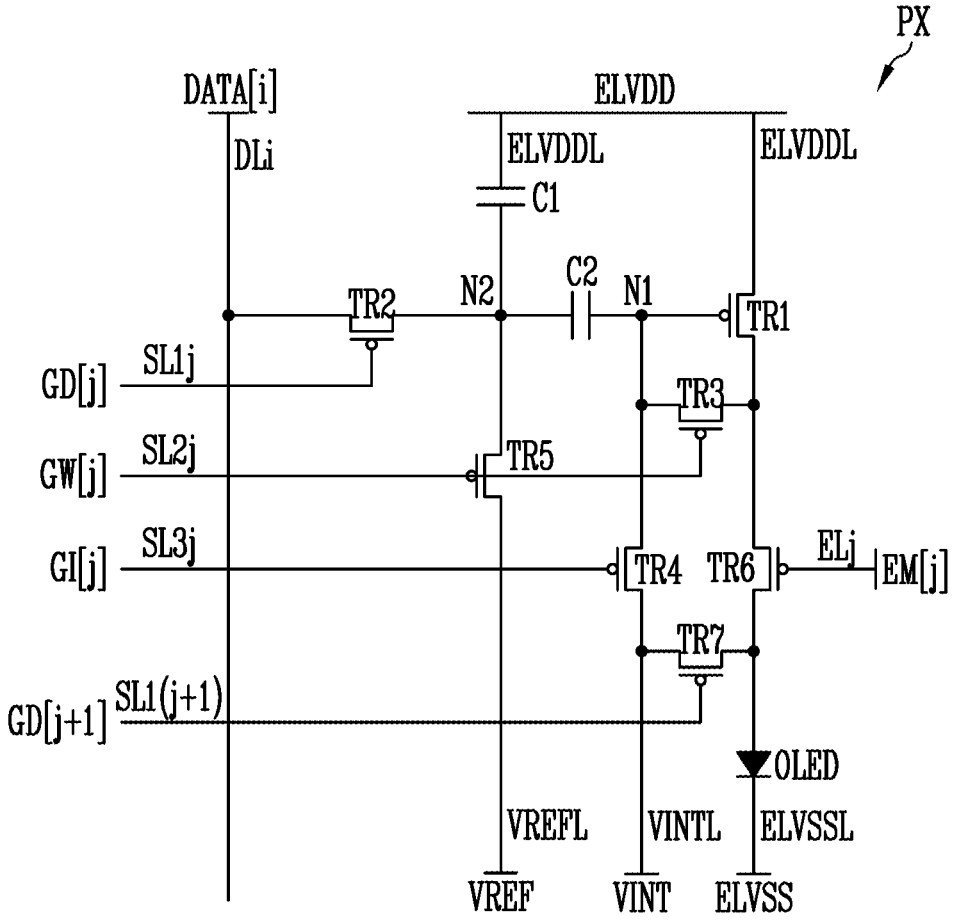
FIG. 2 is an equivalent circuit diagram of a pixel of the organic light emitting display device shown in FIG. 1.

Each of the plurality of pixels PX is supplied with a first power voltage (see 'ELVDD' shown in FIG. 2) and a second power voltage (see 'ELVSS' shown in FIG. 2). The first power voltage may be a predetermined high level voltage, and the second power voltage may be a voltage lower than the first power voltage.

Each of the plurality of pixels PX emits light with a predetermined luminance corresponding to an amount of driving current supplied to the light emitting device based on a data signal (see 'DATA[j]' shown in FIG. 2) transferred through a corresponding data line among the plurality of data lines DL1 to DLm.

The first power voltage, the second power voltage, an initialization voltage (see 'VINT' shown in FIG. 2), a reference voltage (see A/REF' shown in FIG. 2), and the like may be supplied from the power supply 70.

The power supply 70 may receive an external input voltage and provide a power voltage to an output terminal by converting the external input voltage. In one embodiment, for example, the power supply 70 may receive an external input voltage from a battery or the like and boost the external input voltage, thereby generating a power voltage as a voltage higher than the external input voltage. In one embodiment, for example, the power supply 70 may be configured as a power management integrated chip ("PMIC"). In one embodiment, for example, the power supply 70 may be configured as an external direct-current-to-direct current ("DC-DC") integrated circuit ("IC").

Figure 3:
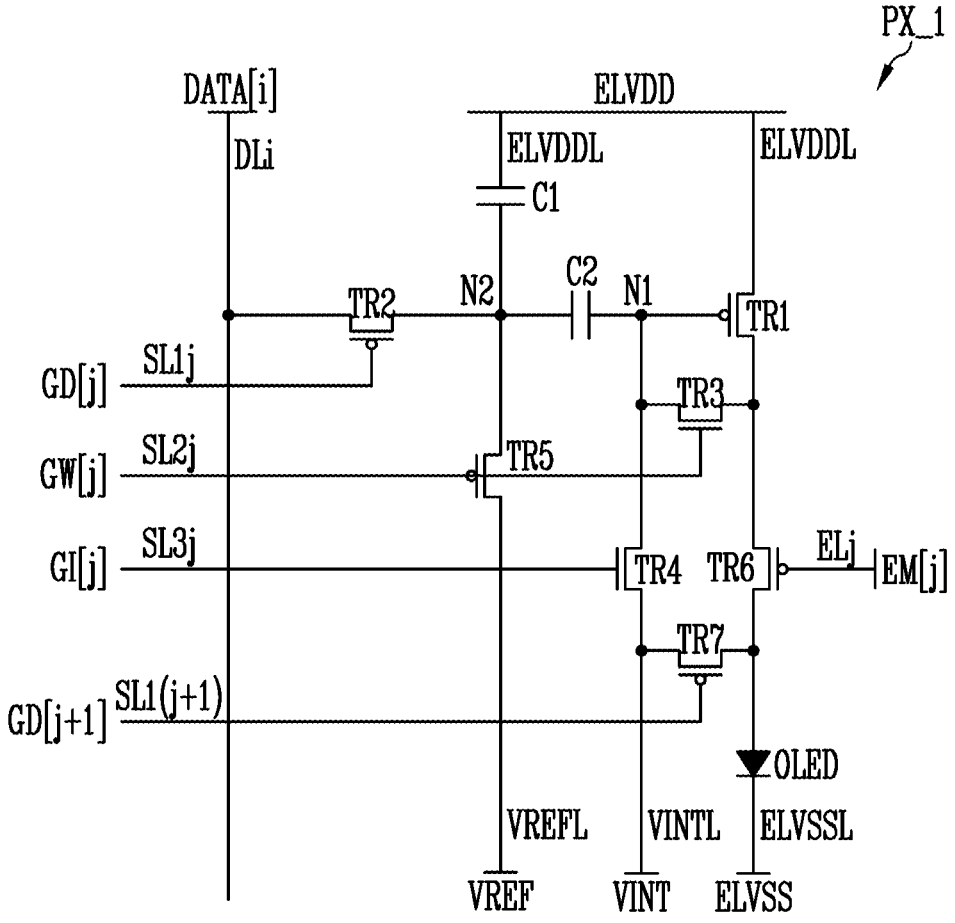
FIG. 3 is an equivalent circuit of a pixel as a modification of the pixel shown in FIG. 2.

FIG. 2 is an equivalent circuit diagram of a pixel of the organic light emitting display device shown in FIG. 1. FIG. 3 is an equivalent circuit of a pixel as a modification of the pixel shown in FIG. 2.

Referring to FIG. 2, in an embodiment, an anode electrode of an organic light emitting diode OLED is coupled to a pixel circuit, and a cathode electrode of the organic light emitting diode OLED is coupled to a second power voltage supply line ELVSSL to which a second power voltage ELVSS is supplied.

In an embodiment, the pixel circuit controls an amount of current supplied to the organic light emitting diode OLED. In such an embodiment, the pixel circuit may include a first transistor TR1, a second transistor TR2, a third transistor TR3, a fourth transistor TR4, a fifth transistor TR5, a sixth transistor TR6, a seventh transistor TR7, a first capacitor C1 and a second capacitor C2.

A first electrode of the first transistor TR1 is coupled to a first power voltage supply line ELVDDL, and a second electrode of the first transistor TR1 is coupled to a first electrode of the sixth transistor TR6. In addition, a gate electrode of the first transistor TR1 is coupled to a first node N1. In an embodiment, the first transistor TR1 may be a driving transistor. In this specification, any one of a first electrode and a second electrode of each of the transistors TR1 to TR7 may be an input terminal, and the other of the first electrode and the second electrode of each of the transistors TR1 to TR7 may be an output terminal. That is, any one of the first electrode and the second electrode of each of the transistors TR1 to TR7 may be a source electrode of each of the transistors TR1 to TR7, and the other of the first electrode and the second electrode of each of the transistors TR1 to TR7 may be a drain electrode of each of the transistors TR1 to TR7.

The first transistor TR1 may control a current flowing through the organic light emitting diode OLED based on an inter-gate-source voltage (threshold voltage). The first transistor TR1 may adjust an emission amount of the organic light emitting diode OLED by controlling a current supplied from the first power voltage supply line ELVDDL to the organic light emitting diode OLED in response to a data signal DATA[i] stored in the second capacitor C2. That is, the first transistor TR1 may control the current supplied to the organic light emitting diode OLED, which corresponds to a voltage applied to the first node N1.

A first electrode and a second electrode of the second transistor TR2 are respectively coupled to a data line DLi ($1 \le i \le m$) and a second node N2. A gate electrode of the second transistor TR2 is coupled to a first scan line SL1*j* ($1 \le j \cdot n$). The second transistor TR2 is turned on when a first scan signal GD[j] is supplied to the first scan line SL1*j*, to electrically couple the second node N2 to the data line DLi.

A first electrode of the third transistor TR3 is coupled to the second electrode of the first transistor TR1, and a second electrode of the third transistor TR3 is coupled to the first node N1. In addition, a gate electrode of the third transistor TR3 is coupled to a second scan line SL2*j*. The third transistor TR3 is turned on when a second scan signal GW[j] is supplied to the second scan line SL2, to electrically couple the first node N1 to the second electrode of the first transistor TR1. Therefore, the first transistor TR1 may be diode-coupled in response to the second scan signal GW[j].

A first electrode of the fourth transistor TR4 is coupled to the first node N1, and a second electrode of the fourth transistor TR4 is coupled to an initialization voltage supply line VINTL. In addition, a gate electrode of the fourth transistor TR4 is coupled to a third scan line SL3*j*. The fourth transistor TR4 is turned on when a third scan signal GI[j] is supplied to the third scan line SL3*j*, to supply an initialization voltage VINT to the first node N1. The fourth transistor TR4 may be turned on when a scan signal is supplied to the third scan line SL3*j*, to initialize the gate electrode of the first transistor TR1 to the initialization voltage VINT. The initialization voltage VINT may be set as a voltage lower than a first power voltage ELVDD, e.g., a voltage lower than a threshold voltage of the first transistor TR1.

A first electrode of the fifth transistor TR5 is coupled to a reference voltage supply line VREFL, and a second electrode of the fifth transistor TR5 is coupled to the second node N2. In addition, a gate electrode of the fifth transistor TR5 is coupled to the second scan line SL2*j*. In an embodiment, the second scan line SL2*j* may be electrically coupled to the gate electrode of the third transistor TR3 and the gate electrode of the fifth transistor TR5. The transistor TR5 is turned on when the second scan signal GW[j] is supplied to the second scan line SL2*j*, to supply a reference voltage VREF to the second node N2. The reference voltage VREF may be set as a voltage higher than a data voltage of white, and be set as a voltage lower than a data voltage of black.

The first electrode of the sixth transistor TR6 is coupled to the second electrode of the first transistor TR1, and a second electrode of the sixth transistor TR6 is coupled to the anode electrode of the organic light emitting diode OLED. In addition, a gate electrode of the sixth transistor TR6 is coupled to an emission control line ELj. The sixth transistor TR6 is turned off when an emission control signal EM[j] is supplied to the emission control line ELj, and is turned on otherwise.

A first electrode of the seventh transistor TR7 is coupled to the anode electrode of the organic light emitting diode OLED, and a second electrode of the seventh transistor TR7 is coupled to the initialization voltage supply line VINTL. In addition, a gate electrode of the seventh transistor TR7 is coupled to a next first scan line SL1(*j*+1) to receive a first scan signal of a next frame GD[j+1]. The seventh transistor TR7 may be referred to as an initialization transistor with respect to the anode electrode.

The first capacitor C1 is coupled between the second node N2 and the first power voltage supply line ELVDDL. The first capacitor C1 may charge a voltage corresponding to the threshold voltage of the first transistor TR1.

The second capacitor C2 is coupled between the first node N1 and the second node N2. The second capacitor C2 may charge a voltage corresponding to the data signal DATA[i]. Also, the second capacitor C2 may control a voltage of the first node N1, which corresponds to a voltage variation of the second node N2.

In an embodiment, the transistors TR1 to TR7 may be implemented with a P-type transistor, e.g., a P-type metal-oxide-semiconductor ("PMOS") transistor. In an embodiment, channels of the transistors TR1 to TR7 may be configured with a poly-silicon. The poly-silicon transistor may be a low temperature poly-silicon ("LTPS") transistor. The poly-silicon transistor has a high electron mobility, and has a fast driving characteristic according to the high electron mobility.

However, the kind of the transistors is not limited thereto. Alternatively, the transistors TR1 to TR7 may be implemented with an N-type transistor, e.g., an N-type metal-oxide-semiconductor ("NMOS") transistor. The channels of the transistors TR1 to TR7 may be configured with an oxide semiconductor. The oxide semiconductor transistor may be formed through a low temperature process, and has a charge mobility lower than that of the poly-silicon transistor. Thus, the oxide semiconductor transistors have an amount of leakage current generated in a turn-off state, which is smaller than that of the poly-silicon transistors.

Referring to FIG. 3, in an alternative embodiment of a pixel PX_1, the first transistor TR1, the second transistor TR2, and the fifth to seventh transistors TR5 to TR7 may be implemented with a P-type transistor, and the third transistor TR3 and the fourth transistor TR4 may be implemented with an N-type transistor. In an embodiment, the seventh transistor TR7 may be configured as an N-type oxide semiconductor transistor instead of a poly-silicon transistor. Alternatively, one of the second scan line SL2*j* and the third scan line SL3*j* may be coupled to the gate electrode of the seventh transistor TR7 in substitution for the next first scan line SL1(*j*+1).

Next, an embodiment of a method in which the organic light emitting display device 1 is variable frequency driven will be described in conjunction with FIGS. 4 to 8.

Figure 4:
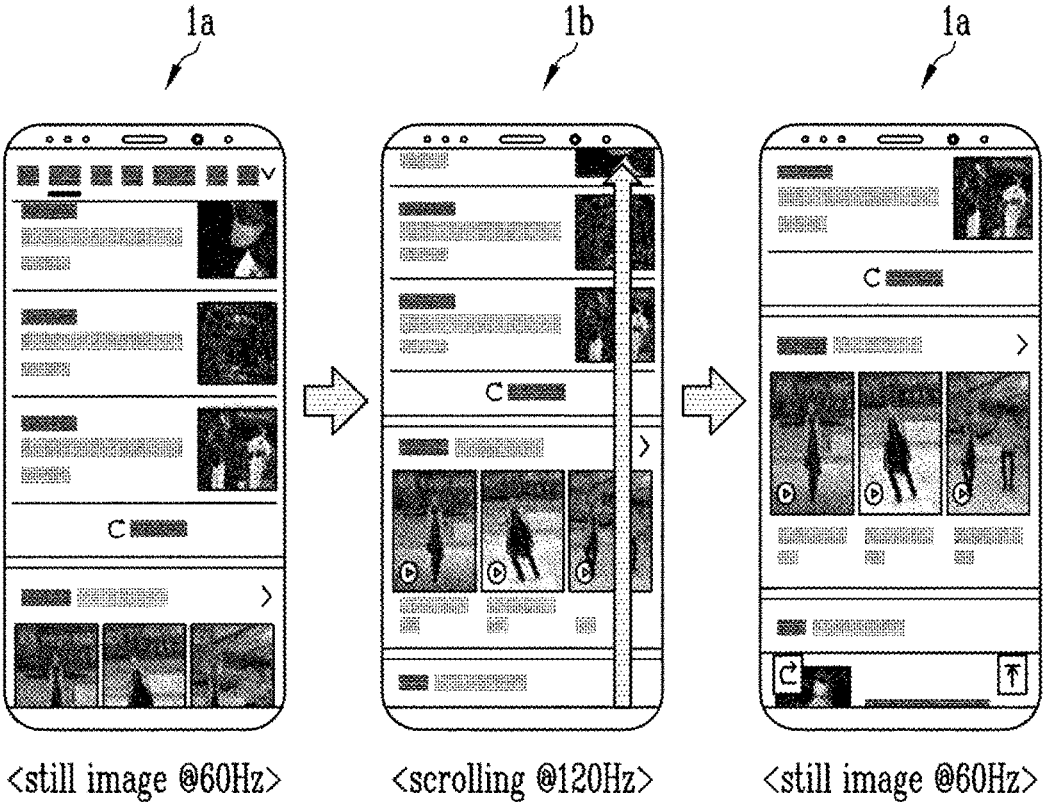
FIG. 4 is a diagram illustrating exemplary screens in variable frequency driving of the organic light emitting display device in accordance with an embodiment of the disclosure.
Figure 5:
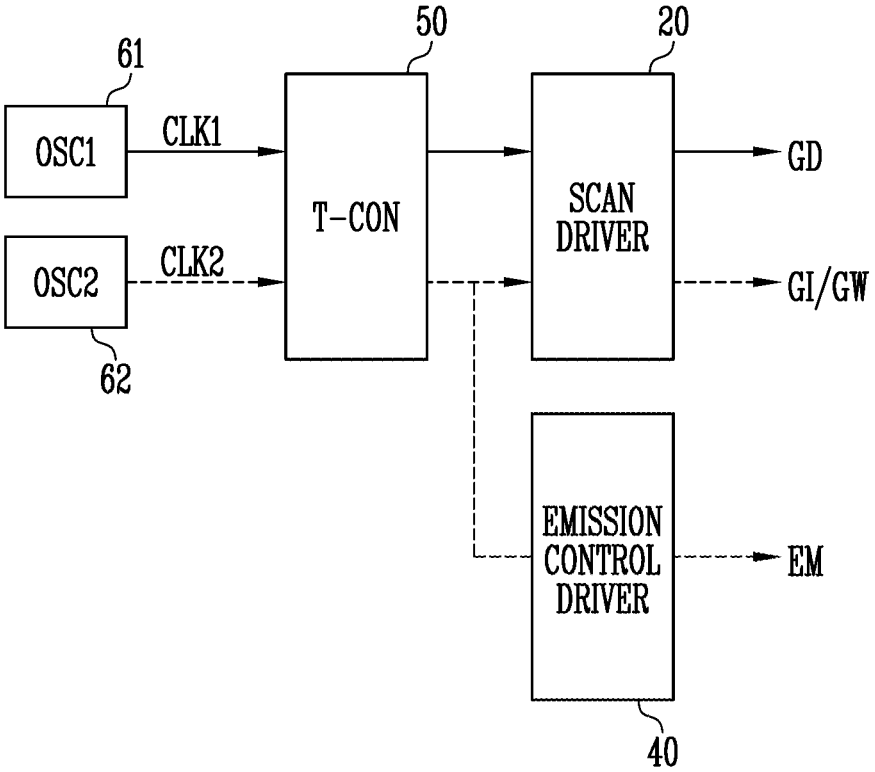
FIG. 5 is a block diagram illustrating a signal generator, a timing to controller and a scan driver of the organic light emitting display device in accordance with an embodiment of the disclosure.
Figure 6:
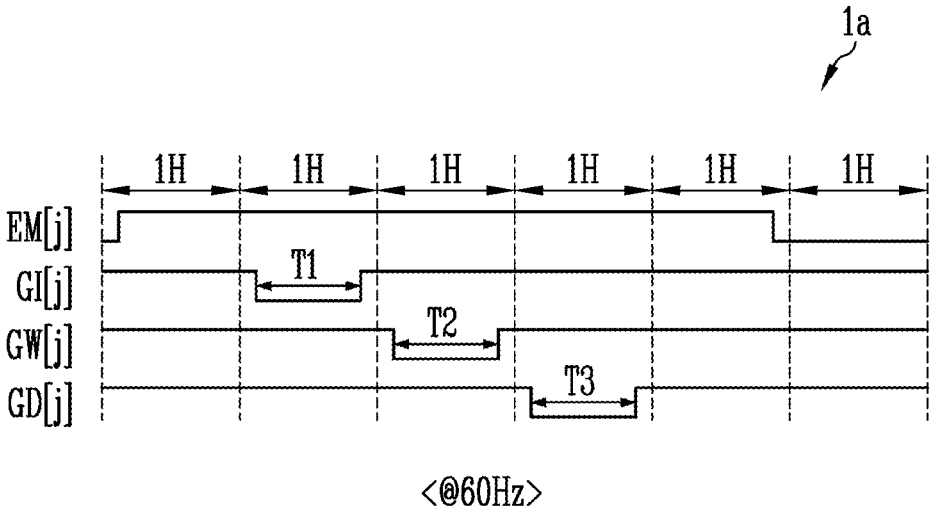
FIG. 6 is a signal timing diagram of signals written to the pixel when the organic light emitting display device is driven at a low frequency in accordance with an embodiment of the disclosure.
Figure 7:
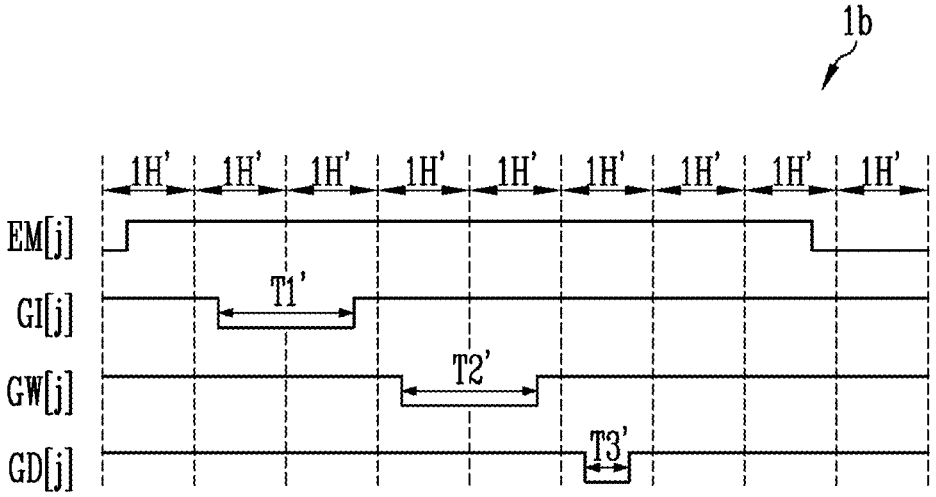
FIG. 7 is a signal timing diagram of signals written to the pixel when the organic light emitting display device is driven at a high frequency in accordance with an embodiment of the disclosure.
Figure 8:
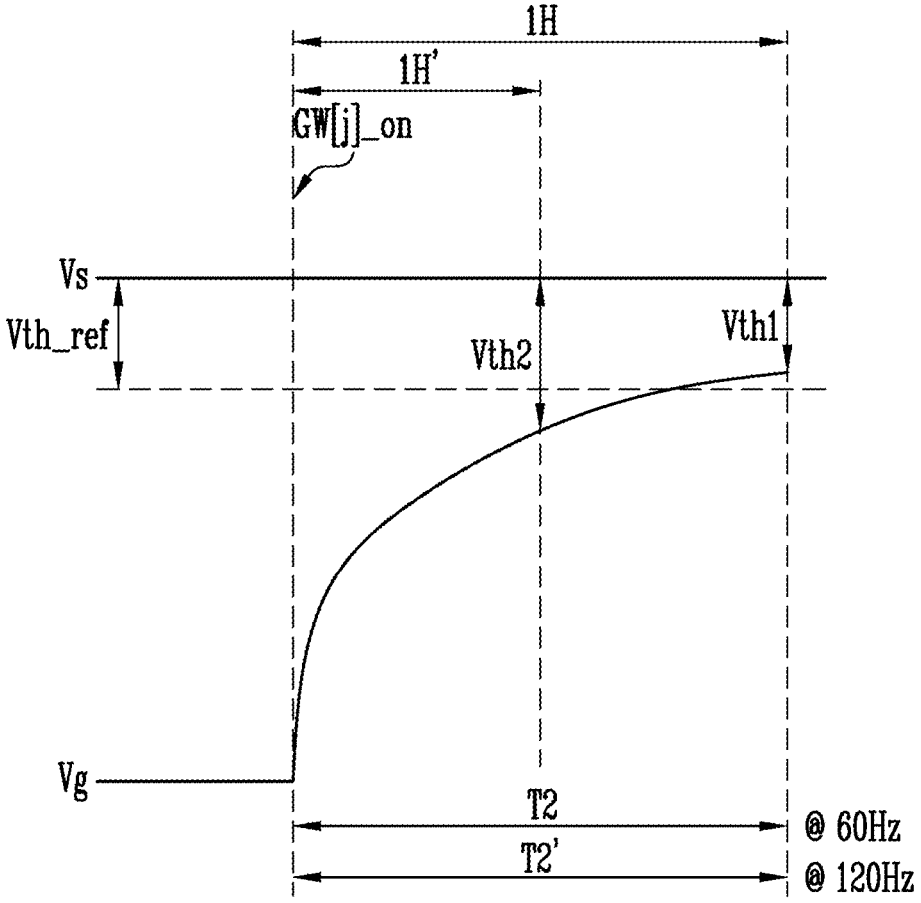
FIG. 8 is a diagram illustrating a case where a threshold voltage of a driving transistor is compensated.

FIG. 4 is a diagram illustrating exemplary screens in variable frequency driving of the organic light emitting display device in accordance with an embodiment of the disclosure. FIG. 5 is a block diagram illustrating the signal generator, the timing controller and the scan driver of the organic light emitting display device in accordance with an embodiment of the disclosure. FIG. 6 is a signal timing diagram of signals written to the pixel when the organic light emitting display device is driven at a low frequency in accordance with an embodiment of the disclosure. FIG. 7 is a signal timing diagram of signals written to the pixel when the organic light emitting display device is driven at a high frequency in accordance with an embodiment of the disclosure. FIG. 8 is a diagram illustrating a case where a threshold voltage of the driving transistor is compensated.

In an embodiment, the organic light emitting display device 1 may be driven with variable frequency or with a variable frequency driving. Here, a frequency driving may mean a driving method according to a screen scanning rate.

The organic light emitting display device 1 may be driven with at least two different frequencies. In one embodiment, for example, the organic light emitting display device 1 may be driven at a frequency of about 1 hertz (Hz) to about 60 Hz in a low frequency driving (1*a*). In such an embodiment, the organic light emitting display device 1 may be driven at a frequency of about 120 Hz to about 250 Hz in a high frequency driving (1*b*). In one embodiment, for example, when the organic light emitting display device 1 displays a still image, the organic light emitting display device 1 may be driven at a low frequency. In such an embodiment, when the organic light emitting display device 1 displays a movie image (e.g., scrolling), the organic light emitting display device 1 may be driven at a high frequency. In such an embodiment, when the organic light emitting display device 1 again displays a still image, the organic light emitting display device 1 may be driven at a low frequency.

Hereinafter, an embodiment where the organic light emitting display device 1 is driven at a frequency of 60 Hz when the organic light emitting display device 1 is driven at a low frequency, and is driven at a frequency of 120 Hz when the organic light emitting display device 1 is driven at a high frequency will be described in detail, but not being limited thereto.

In an embodiment, as shown in FIG. 5, the first signal generator 61 may provide the first clock signal CLK1 to the timing controller 50, and control the first scan signal GD[j] of the scan driver 20 through the timing controller 50. In one embodiment, for example, the first signal generator 61 may supply the first clock signal CLK1 to the scan driver 20 through the timing controller 50 such that the scan driver 20 may generate the first scan signal GD[j] based on the first clock signal CLK1 to write the data signal DATA[i] to the pixel circuit.

In an embodiment, the second signal generator 62 may provide the second clock signal CLK2 to the timing controller 50, and control the second scan signal GW[j] and the third scan signal GI[j] of the scan driver 20 through the timing controller 50. In one embodiment, for example, the second signal generator 62 may supply the second clock signal CLK2 to the scan driver 20 through the timing controller 50 such that the scan driver 20 may generate the first scan signal GD[j] and the second scan signal GW[j] based on the second clock signal CLK2 to supply the initialization voltage VINT and the reference voltage VREF to the pixel circuit. In an embodiment, the second signal generator 62 may provide the second clock signal CLK2 and control the emission control driver 40 through the timing controller 50. In one embodiment, for example, the second signal generator 62 may supply the second clock signal CLK2 to the emission control driver 40 through the timing controller 50 such that the emission control driver 40 may generate the emission control signal EMU[j] based on the second clock signal CLK2 to supply the emission control signal EMU[j] to the pixel circuit.

First, a case where the organic light emitting display device 1 is driven at the frequency of 60 Hz (1*a*) will be described. When the organic light emitting display device 1 is driven at the low frequency of 60 Hz, one horizontal period (hereinafter will be referred to as 1H) may be about 1.67 millisecond (ms) (i.e., 1/60 second).

Referring to FIGS. 3 and 6, in an embodiment, the sixth transistor TR6 may be maintained in a turn-off state from a turn-on state due to the emission control signal EMU[j]. Accordingly, electrical coupling between the first transistor TR1 and the organic light emitting diode OLED may be interrupted while the sixth transistor TR6 is maintained in the turn-off state. The organic light emitting diode OLED may be set to be in a non-emission state.

The third scan signal GI[j], the second scan signal GW[j], and the first scan signal GW[j] may be sequentially applied during a period in which the organic light emitting diode OLED does not emit light. Accordingly, the fourth transistor TR4, the third transistor TR3, and the second transistor TR2 may be sequentially turned on while the sixth transistor TR6 is maintained in the turn-off state.

In such an embodiment, as shown in FIG. 6, during a first period T1, the third scan signal GI[j] may be supplied to the gate electrode of the fourth transistor TR4 through the third scan line SL3*j*. The third scan signal GI[j] may be generated when the second signal generator 62 provides the second clock signal CLK2 to the timing controller 50, and the timing controller 50 controls the scan driver 20, based on the second clock signal CLK2.

In such an embodiment, the fourth transistor TR4 may be turned on during the first period T1. In one embodiment, for example, the first period T1 may have a time length of about 1.67 ms that is 1H in the low frequency driving (1*a*).

When the fourth transistor TR4 is turned on, the initialization voltage VINT may be applied to the gate electrode of the first transistor TR1. That is, the gate electrode of the first transistor TR1 may be shifted to a voltage level of the initialization voltage VINT. The first period T1 may be a period in which the gate electrode of the driving transistor is initialized.

Subsequently, during a second period T2, the second scan signal GW[j] may be supplied to the gate electrode of each of the third transistor TR3 and the fifth transistor TR5 through the second scan line SL2*j*. The second scan signal GW[j] may be generated when the second signal generator 62 provides the second clock signal CLK2 to the timing controller 50, and the timing controller 50 controls the scan driver 20, based on the second clock signal CLK2.

In the second period T2, the third transistor TR3 and the fifth transistor TR5 may be turned on. In one embodiment, for example, the second period T2 may have a time length of 1.67 ms that is 1H in the low frequency driving (1*a*).

Referring to FIGS. 3 and 8, when the third transistor TR3 is turned on in response to the second scan signal GW[j]_on, the initialization voltage VINT may be applied to the second electrode of the first transistor TR1. That is, the second electrode of the first transistor TR1 may be shifted to the initialization voltage VINT. A difference in voltage between a gate (Vg) and a source (Vs) of the first transistor TR1 may be gradually decreased by the gate electrode coupled to the second capacitor C2 and the second electrode to which the initialization voltage VINT is applied. The second period T3 may be a period in which a threshold voltage variation of the driving transistor is compensated.

In an embodiment, when a period in which the difference in voltage between the gate (Vg) and the source (Vs) of the driving transistor is sufficiently secured, the difference in voltage between the gate (Vg) and the source (Vs) of the first transistor TR1 is to be lower than a threshold voltage Vth, so that any luminance change (e.g., flickering) is not recognized by a user. In one embodiment, for example, when the period in which the difference in voltage between the gate (Vg) and the source (Vs) of the driving transistor is given as about 1.67 ms, the difference in voltage between the gate (Vg) and the source (Vs) of the driving transistor may become a first voltage level Vth1. The first voltage level Vth1 may be lower than a threshold voltage level Vth_ref. The first voltage level Vth1 may be a voltage level obtained by compensating for the difference in voltage between the gate (Vg) and the source (Vs) of the driving transistor such that the luminance change is not recognized by the user.

Subsequently, during a third period T3, the first scan signal GD[j] may be supplied to the gate electrode of the second transistor TR2 through the third scan line SL3*j*. The first scan signal GD[j] may be generated when the first signal generator 61 provides the first clock signal CLK1 to the timing controller 50, and the timing controller 50 controls the scan driver 20, based on the first clock signal CLK1.

In the third period T3, the second transistor TR2 may be turned on. In one embodiment, for example, the third period T3 may have a time length of about 1.67 ms that is 1H in the low frequency driving (1*a*).

When the second transistor TR2 is turned on, the data line DLi and the second node N2 may be electrically coupled to each other. When the data line DLi and the second node N2 are electrically coupled to each other, the data signal DATA[i] from the data line DLi may be supplied to the second node N2. Since the second transistor TR2 is set to be in the turn-on state during a period of 1H, the data signal DATA[i] corresponding to the turn-on state may be supplied. Accordingly, a predetermined voltage of the data signal DATA[i] may be applied to the second node N2. The second capacitor C2 apply the predetermined voltage of the data signal DATA[i] to the first node N1 to which the gate electrode of the first transistor TR1 is coupled corresponding to a voltage variation of the second node N2.

Next, a case where the organic light emitting display device 1 is driven at the high frequency of 120 Hz (1*b*) will be described. When the organic light emitting display device 1 is driven at the high frequency of 120 Hz, 1H' may be about 0.83 ms (i.e., 1/120 second).

Referring to FIGS. 3 and 7, the sixth transistor TR6 may be maintained in the turn-off state from the turn-on state due to the emission control signal EM[i]. Accordingly, electrical coupling between the first transistor TR1 and the organic light emitting diode OLED may be interrupted while the sixth transistor TR6 is maintained in the turn-off state. The organic light emitting diode OLED may be set to be in the non-emission state.

When the organic light emitting display device 1 is driven at the high frequency of 120 Hz, the third scan signal GI[j], the second scan signal GW[j], and the first scan signal GD[j] may be sequentially applied during a period in which the organic light emitting diode OLED does not emit light. Accordingly, the fourth transistor TR4, the third transistor TR3, and the second transistor TR2 may be sequentially turned on while the sixth transistor TR6 is maintained in the turn-off state.

First, during a first period T1', the third scan signal GI[j] may be supplied to the gate electrode of the fourth transistor TR4 through the third scan line SL3*j*. In addition, the fourth transistor TR4 may be turned on. In an embodiment, a length of the first period T1' in the high frequency driving (1*b*) may be equal to that of the first period T1 in the low frequency driving (1*a*). In one embodiment, for example, the first period T1' may have a time length of about 1.67 ms that is 2H' in the high frequency driving (1*b*). That is, a pulse width of the third scan signal GI[j] in the high frequency driving (1*b*) may be equal to that of the third scan signal GI[j] in the low frequency driving (1*a*).

When the fourth transistor TR4 is turned on, the initialization voltage VINT may be applied to the gate electrode of the first transistor TR1. That is, the gate electrode of the first transistor TR1 may be shifted to the voltage level of the initialization voltage VINT. The first period T1' may be a period in which the gate electrode of the driving transistor is initialized.

Accordingly, even in the high frequency driving (1*b*), a length of the period in which the gate electrode of the driving transistor is initialized may be secured at a same level as that in the low frequency driving (1*a*).

Subsequently, during a second period T2', the second scan signal GW[j] may be supplied to the gate electrode of each of the third transistor TR3 and the fifth transistor TR5 through the second scan line SL2*j*. In the second period T2', the third transistor TR3 and the fifth transistor TR5 may be turned on. In an embodiment, a length of the second period T2' in the high frequency driving (1*b*) may be equal to that of the second period T2 in the low frequency driving (1*a*). In one embodiment, for example, the second period T2' in the high frequency driving (1*b*) may have a time length of about 1.67 ms that is 2H' in the high frequency driving (1*b*). That is, a pulse width of the second scan signal GW[j] in the high frequency driving (1*b*) may be equal to that of the second scan signal GW[j] in the low frequency driving (1*a*).

Accordingly, even in the high frequency driving (1*b*), a period in which the threshold voltage of the driving transistor is compensated may be secured at a same level as that in the low frequency driving (1*a*). As shown in FIG. 8, if the period in which the threshold voltage of the driving transistor is compensated is 0.83 ms that is 1H', the difference in voltage between the gate (Vg) and the source (Vs) of the driving transistor may have a second voltage level Vth2 higher than the threshold voltage level Vth_ref, and a luminance change may be recognized by a user.

In an embodiment, a compensation time of the difference in voltage between the gate (Vg) and the source (Vs) of the driving transistor in the high frequency driving (1*b*) is secured to be about 1.67 ms as in the low frequency driving (1*a*), so that the difference in voltage between the gate (Vg) and the source (Vs) of the driving transistor may have the first voltage level Vth1. In such an embodiment, the difference in voltage between the gate (Vg) and the source (Vs) of the driving transistor may be sufficiently compensated to such that the luminance change is not recognized by the user even in the high frequency driving (1*b*).

Subsequently, during a third period T3', the first scan signal GD[j] may be supplied to the second transistor TR2 through the first scan line SL1*j*. In the third period T3', the second transistor TR2 may be turned on. In one embodiment, for example, the third period T3' may have a time length of about 0.83 ms that is 1 H' in the high frequency driving (1*b*).

Since the first signal generator 61 that generates the first scan signal GI[j] and the second signal generator 62 that generates the second and third signals GW[j] and GI[j] are configured separately from or provided independently of each other, the first signal generator 61 and the second signal generator 62 may have different pulse widths even in a same frequency driving.

Next, an organic light emitting display device in accordance with an alternative embodiment of the disclosure will be described. Hereinafter, the same or like components as those described above with reference to FIGS. 1 to 8 are designated by the same or like reference numerals, and any repetitive detailed description thereof will be omitted.

Figure 9:
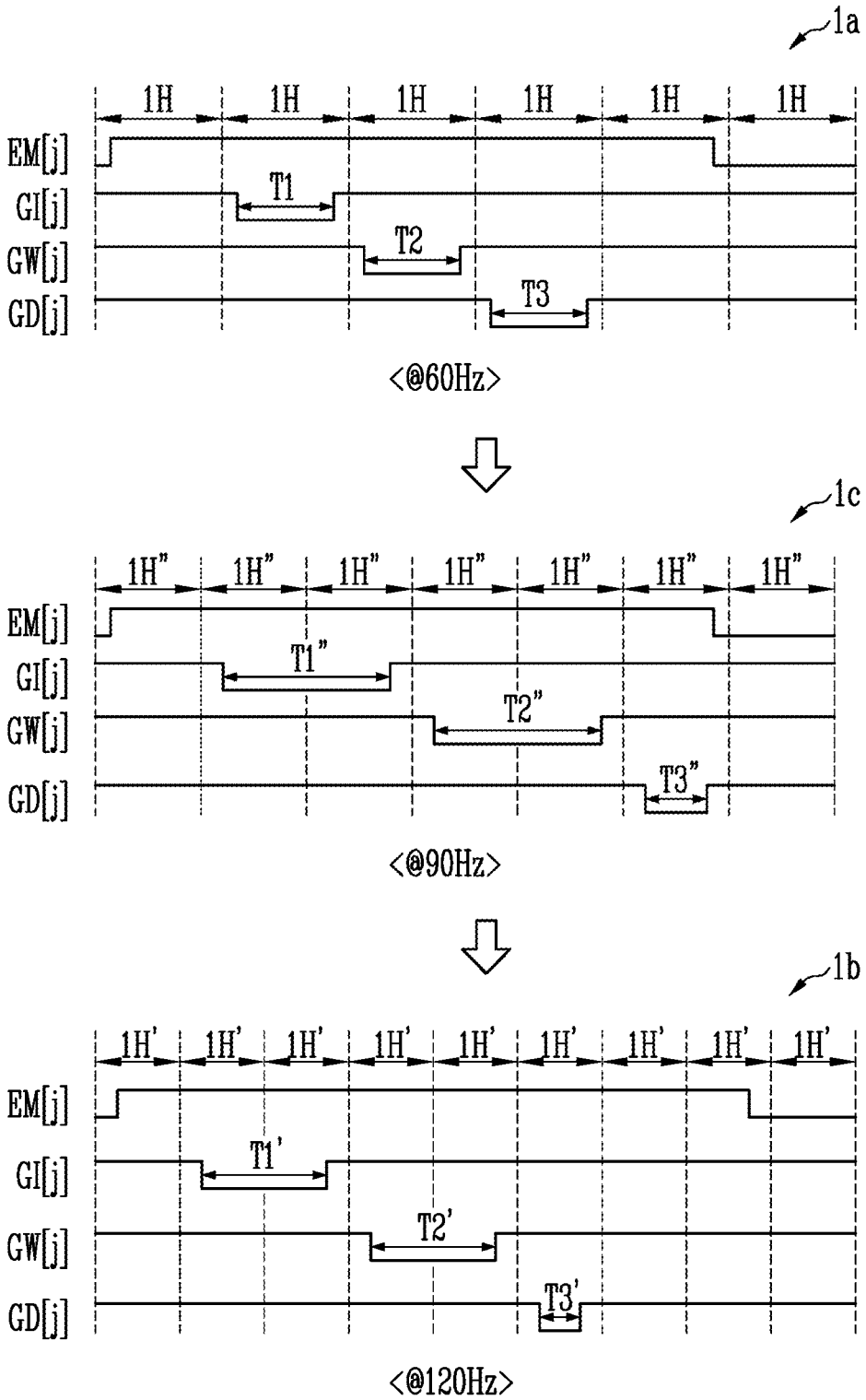
FIG. 9 is a signal timing diagram of signals written to a pixel when an organic light emitting display device is driven at a low frequency in accordance with an alternative embodiment of the disclosure.

FIG. 9 is a signal timing diagram of signals written to a pixel when an organic light emitting display device is driven at a low frequency in accordance with an alternative embodiment of the disclosure.

Referring to FIG. 9, the organic light emitting display device is substantially the same as the organic light emitting display device 1 described above with reference to FIGS. 6 and 7, except that the organic light emitting to display device is driven with a variable frequency driving at a first frequency, a second frequency, and a third frequency.

The organic light emitting display device may be driven with a variable frequency driving by using interpolation. In one embodiment, for example, the organic light emitting display device may be set to be intermediate frequency driven between the low frequency driving (1*a*) and the high frequency driving (1*b*).

The organic light emitting display device may be driven with a variable frequency driving using a first frequency, a second frequency, and a third frequency. In an embodiment, the first frequency may be in a range of about 1 Hz to about 60 Hz, the second frequency may be in a range of about 60 Hz to about 120 Hz, and the third frequency may be in a range of about 120 Hz to about 250 Hz. Hereinafter, for convenience of description, an embodiment where the first frequency is 60 Hz, the second frequency is 90 Hz, and the third frequency is 120 Hz will be described in detail, but not being limited thereto.

In such an embodiment, the low frequency driving (1*a*) and the high frequency driving (1*b*) are substantially the same as those described above, and any repetitive detailed description thereof will be omitted.

When the organic light emitting display device is driven at an intermediate frequency of 90 Hz (1*c*), 1H" may be about 1.11 ms (i.e., 1/90 second).

The sixth transistor TR6 may be maintained in the turn-off state from the turn-on state due to the emission control signal EMU[j]. Accordingly, electrical coupling between the first transistor TR1 and the organic light emitting diode OLED may be interrupted while the sixth transistor TR6 is maintained in the turn-off state. The organic light emitting diode OLED may be set to be in the non-emission state.

The third scan signal GI[j], the second scan signal GW[j], and the first scan signal GW[j] may be sequentially applied during a period in which the organic light emitting diode OLED does not emit light. Accordingly, the fourth transistor TR4, the third transistor TR3, and the second transistor TR2 may be sequentially turned on while the sixth transistor TR6 is maintained in the turn-off state.

First, during a first period T1", the third scan signal GI[j] may be supplied to the gate electrode of the fourth transistor TR4 through the third scan line SL3*j*. In the first period T1", the fourth transistor TR4 may be turned on. In an embodiment, a length of the first period T1" in second frequency driving (1*c*) may be equal to that of a first period T1 in first frequency driving (1*a*). In one embodiment, for example, the first period T1" in the second frequency driving (1*c*) may have a time length of about 1.67 ms that is 1.5H" in the second frequency driving (1*c*).

Accordingly, even in the second frequency driving (1*c*), a period in which the gate electrode of the driving transistor is initialized may be secured at a same level as that in the first frequency driving (1*a*).

Subsequently, during a second period T2", the second scan signal GW[j] may be supplied to the gate electrode of each of the third transistor TR3 and the fifth transistor TR5 through the second scan line SL2*j*. In the second period T2", the third transistor TR3 and the fifth transistor TR5 may be turned on. In an embodiment, a length of the second period T2" in the second frequency driving (1*c*) may be equal to that of a second period T2 in the first frequency driving (1*a*). In one embodiment, for example, the second period T2" in the second frequency driving may have a time length of about 1.67 ms that is 1.5H" in the second frequency driving (1*c*).

Accordingly, even in the second frequency driving (1*c*), a period in which the difference in voltage between the gate and the source of the driving transistor is compensated may be secured at a same level as that in the first frequency driving 1*a*.

Subsequently, during a third period T3", the first scan signal GD[j] may be supplied to the gate electrode of the second transistor TR2 through the first scan line SL1*j*. In the third period T3", the second transistor TR2 may be turned on. In one embodiment, for example, the third period T3" in the second frequency driving (1*c*) may have a time length of about 1.11 ms that is 1H" in the second frequency driving (1*c*).

In such an embodiment, as described above, since the first signal generator 61 that generates the first scan signal GI[j] and the second signal generator 62 that generates the second and third signals GW[j] and GI[j] are configured separately from or provided independently of each other, the first signal generator 61 and the second signal generator 62 may be set to have different pulse widths even in a same frequency driving.

Through the variable frequency driving using the interpolation, the organic light emitting display device may effectively prevent a luminance change in frequency variation from being recognized by a user.

Figure 10:
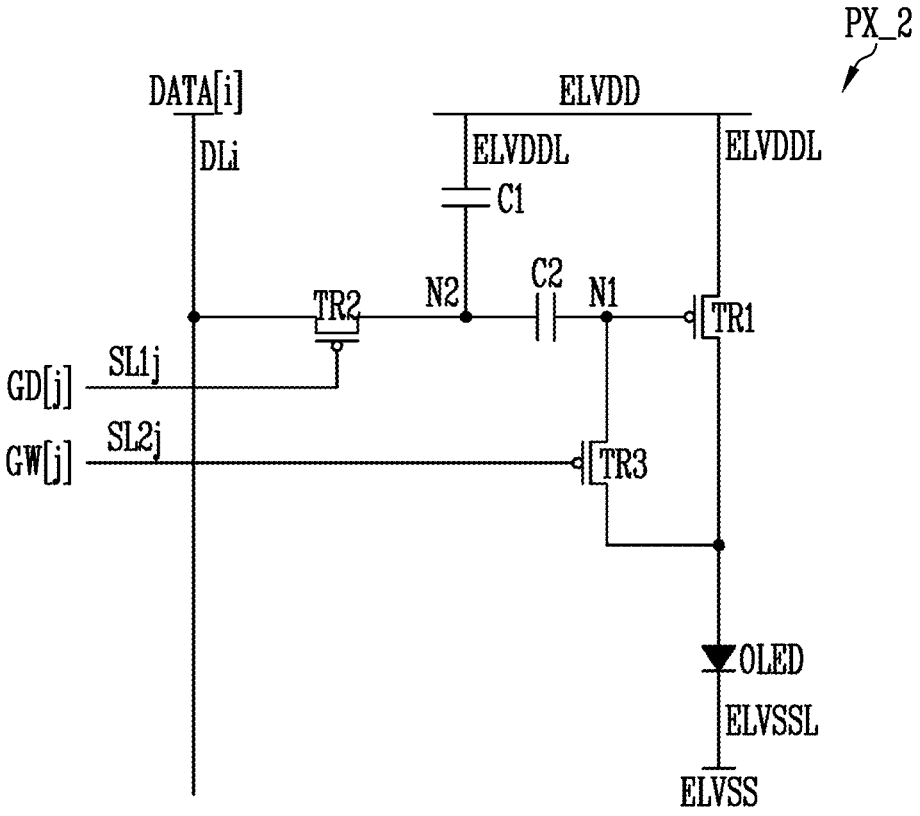
FIG. 10 is an equivalent circuit diagram illustrating a pixel of an organic light emitting display device in accordance with another alternative embodiment of the disclosure.
Figure 11:
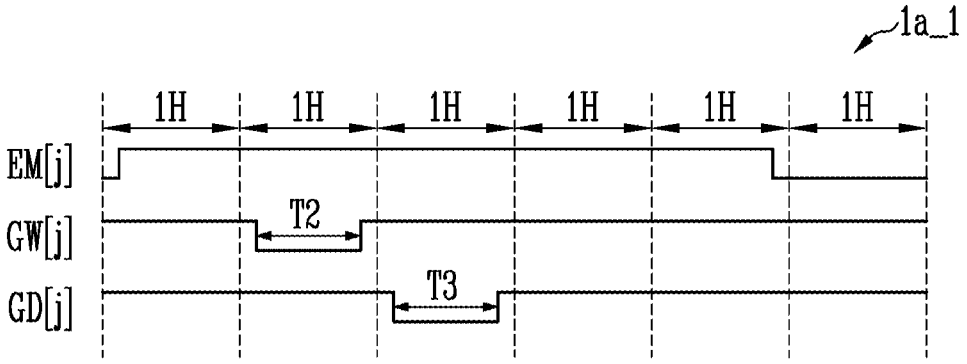
FIG. 11 is a signal timing diagram of signals written to the pixel when the organic light emitting display device shown in FIG. 10 is driven at a low frequency.
Figure 12:
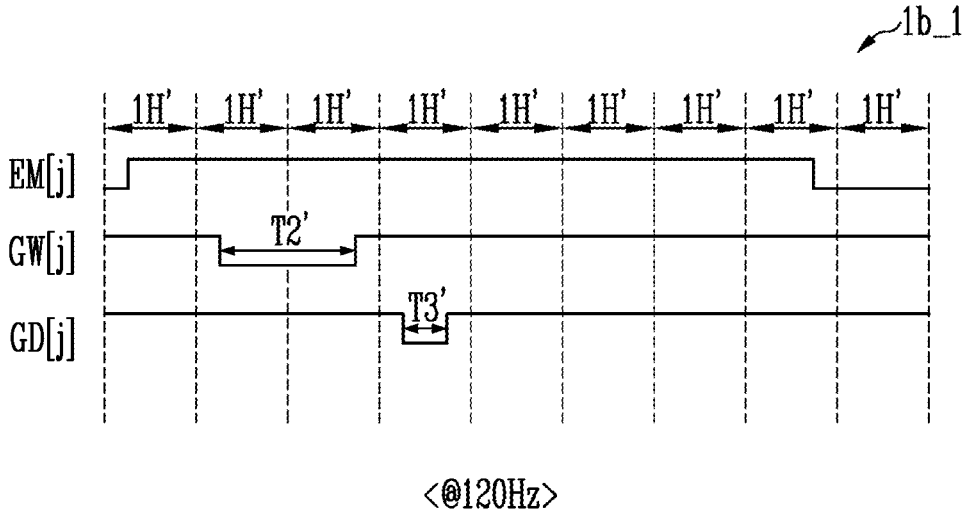
FIG. 12 is a signal timing diagram of signals written to the pixel when the organic light emitting display device shown in FIG. 10 is driven at a high frequency.

FIG. 10 is an equivalent circuit diagram illustrating a pixel of an organic light emitting display device in accordance with another alternative embodiment of the disclosure. FIG. 11 is a timing diagram of signals written to the pixel when the organic light emitting display device shown in FIG. 10 is driven at a low frequency. FIG. 12 is a timing diagram of signals written to the pixel when the organic light emitting display device shown in FIG. 10 is driven at a high frequency.

Referring to FIGS. 10 to 12, the organic light emitting display device is substantially the same as the organic light emitting display device described above with reference to FIGS. 2, 6, and 7, except that the pixel circuit includes only three transistors.

In an embodiment, a pixel PX_2 of the organic light emitting display device includes an organic light emitting diode OLED and a pixel circuit to which the organic light emitting diode OLED is coupled.

In such an embodiment, as shown in FIG. 10, the pixel circuit includes a first transistor TR1, a second transistor TR2, a third transistor TR3, a first capacitor C1, and a second capacitor C2. In an embodiment, the pixel circuit has a 3TR2C structure, but may be variously modified. In an alternative embodiment, the pixel circuit may include an additional transistor and an additional capacitor, which are used to implement a compensation circuit. In one embodiment, for example, the pixel circuit may be designed in various structures such as a 4TR2C structure, a 5TR2C structure, and a 6TR2C structure.

A first electrode of the first transistor TR1 may be coupled to a first power voltage supply line ELVDDL, and a second electrode of the first transistor TR1 may be coupled to an anode electrode of the organic light emitting diode OLED. A gate electrode of the first transistor TR1 may be coupled to a first node N1.

The second transistor TR2 may be coupled to a data line DLi to apply a data signal DATA[i] to the gate electrode of the first transistor TR1. A first electrode of the second transistor TR2 may be coupled to the data line DLi, and a second electrode of the second transistor TR2 may be coupled to a second node N2. A first scan signal GD[j] may be applied to a gate electrode of the second transistor TR2. In an embodiment, the first scan signal GD[j] and a second scan signal GW[j] may be signals identical to or different from each other.

A first electrode of the third transistor TR3 may be coupled to the first node N1, and a second electrode of the third transistor TR3 may be coupled to the second electrode of the first transistor TR1 and the anode electrode of the organic light emitting diode OLED. The second scan signal GW[j] may be applied to a gate electrode of the third transistor TR3.

The first capacitor C1 may be coupled between the first power voltage supply line ELVDDL and the second node N2, and the second capacitor C2 may be coupled between the first node N1 and the second node N2.

In such an embodiment, since the first signal generator 61 and the second signal generator 62 are configured separately from or provided independently of each other, pulse width of the first scan signal GD[j] and the second scan signal GW[j] may be controlled independently of each other. Accordingly, when the organic light emitting display device is driven at a high frequency (1*b*_1), the second scan signal GW[j] may be applied at a time level having a same time length as that when the organic light emitting display device is driven at a low frequency (1*a*_1).

In such an embodiment, when the organic light emitting display device is driven at the high frequency (1*b*_1), a period in which a difference in voltage between a gate and a source of the first transistor TR1 is compensated may be secured, such that a luminance change may be effectively prevented from being recognized by a user.

In accordance with embodiments of the disclosure, as set forth herein, a compensation time in high frequency driving is secured at a same level as that in low frequency driving, such that a luminance change of the display device may be effectively prevent from being recognized by a user.

The invention should not be construed as being limited to the embodiments set forth herein. Rather, these embodiments are provided so that this disclosure will be thorough and complete and will fully convey the concept of the invention to those skilled in the art.

While the invention has been particularly shown and described to with reference to embodiments thereof, it will be understood by those of ordinary skill in the art that various changes in form and details may be made therein without departing from the spirit or scope of the invention as defined by the following claims.

What is claimed is:

1. A display device comprising:

a plurality of pixels, wherein each of the pixels includes a light emitting device, and a pixel circuit coupled to the light emitting device;

a scan driver which supplies a scan signal to the pixel circuit;

a data driver which supplies a data signal to the pixel circuit;

a power supply which supplies a voltage to the pixel circuit;

a timing controller which controls the scan driver;

a first signal generator which provides a first clock signal to the timing controller; and a second signal generator which provides a second clock signal to the timing controller, wherein the timing controller controls the scan driver based on the first clock signal to supply a first scan signal to the pixel circuit, and controls the scan driver based on the second clock signal to supply a second scan signal to the pixel circuit, wherein the first signal generator and the second signal generator are provided independently of each other, so that pulse widths of the first scan signal and the second scan signal are controlled independently of each other, and wherein the first signal generator and the second signal generator are oscillators.

2. The display device of claim 1, wherein the data signal is supplied to the pixel circuit from the data driver, while the first scan signal is being supplied to the pixel circuit, and the voltage is supplied to the pixel circuit from the power supply, while the second scan signal is being supplied to the pixel circuit.

3. The display device of claim 2, wherein the first scan signal and the second scan signal are supplied to the pixel circuit, while the light emitting device is not emitting light.

4. The display device of claim 3, wherein the first scan signal is supplied to the pixel circuit after the second scan signal is supplied to the pixel circuit.

5. The display device of claim 2, wherein the voltage is an initialization voltage for initializing a gate electrode of a driving transistor in the pixel circuit.

6. The display device of claim 1, further comprising:

a data line to which the data signal is supplied;

a first scan line to which a first scan signal is supplied from the scan driver;

a second scan line to which a second scan signal is supplied from the scan driver; and a first power voltage supply line to which a first power voltage is supplied from the power supply, wherein the pixel circuit includes:

a first transistor including a first electrode coupled to the first power voltage supply line, a second electrode, and a first gate electrode coupled to a first node;

a second transistor including a third electrode coupled to the data line, a fourth electrode coupled to a second node, and a second gate electrode coupled to the first scan line; and a third transistor including a fifth electrode coupled to the first node, a sixth electrode coupled to the second electrode, and a third gate electrode coupled to the second scan line.

7. The display device of claim 6, wherein the pixel circuit further includes:

a first capacitor coupled between the first power voltage supply line and the second node; and a second capacitor coupled between the first node and the second node.

8. The display device of claim 7, further comprising:

a third scan line to which a third scan signal is supplied from the scan driver; and an initialization voltage supply line to which an initialization voltage is supplied from the power supply, wherein the pixel circuit further includes a fourth transistor including a seventh electrode coupled to the first node, an eighth electrode coupled to the initialization voltage supply line, and a fourth gate electrode coupled to the third scan line.

9. The display device of claim 8, wherein during a period in which the light emitting device does not emit light, the second scan signal is supplied to the pixel circuit after the third scan signal is supplied to the pixel circuit, and the first scan signal is supplied to the pixel circuit after the second scan signal is supplied to the pixel circuit.

10. The display device of claim 8, wherein each of the first transistor, the second transistor, the third transistor and the fourth transistor is a P-type transistor.

11. The display device of claim 6, wherein the first scan signal is supplied from the scan driver when the first clock signal is provided thereto, and the second scan signal is supplied from the scan driver when the second clock signal is supplied thereto.

12. The display device of claim 11, wherein the display device is driven with a variable frequency driving using a first frequency and a second frequency, which are different from each other.

13. The display device of claim 12, wherein a length of a time for which the second scan signal is supplied to the pixel circuit when the display device is driven at the first frequency is equal to a length of a time for which the second scan signal is supplied to the pixel circuit when the display device is driven at the second frequency.

14. The display device of claim 12, wherein the first frequency is in a range of about 1 Hz to about 60 Hz, and the second frequency is in a range of about 120 Hz to about 250 Hz.

15. The display device of claim 14, wherein the display device is driven with a variable frequency driving further using a third frequency different from the first frequency and the second frequency, wherein the third frequency is in a range of about 60 Hz to about 120 Hz.

16. The display device of claim 1, wherein the first signal generator and the second signal generator are disposed at an outside of the timing controller and the scan driver.

17. A method for driving a display device, which is driven with a variable frequency driving using a first frequency and a second frequency, which are different from each other, the method comprising:

providing, by a first signal generator of the display device, a first clock signal to a timing controller of the display device, and supplying, by a scan driver of the display device, a first scan signal to a pixel circuit of the display device based on the first clock signal, wherein the scan driver is controlled by the timing controller; and providing, by a second signal generator of the display device, a second clock signal to the timing controller, and supplying, by the scan driver, a second scan signal to the pixel circuit based on the second clock signal, wherein the first signal generator and the second signal generator are provided independently of each other, so that pulse widths of the first scan signal and the second scan signal are controlled independently of each other, and wherein the first signal generator and the second signal generator are oscillators.

18. The method of claim 17, further comprising:

providing, by the first signal generator, the first clock signal to the timing controller, and supplying, by the scan driver, a third scan signal to the pixel circuit based on the first clock signal; and providing, by the second signal generator, the second clock signal to the timing controller, and supplying, by the scan driver, supplying a fourth scan signal to the pixel circuit based on the second clock signal, wherein the first scan signal and the second scan signal are supplied to the pixel circuit when the display device is driven at the first frequency, wherein the third scan signal and the fourth scan signal are supplied to the pixel circuit when the display device is driven at the second frequency, wherein a length of a time for which the first scan signal is supplied to the pixel circuit is different from a length of a time for which the third scan signal is supplied to the pixel circuit, and a length of the time for which the second scan signal is supplied to the pixel circuit is equal to length of a time for which the fourth scan signal is supplied to the pixel circuit.

* * * * *